United States Patent [19]

Zacharias

[11] 4,255,956

[45] Mar. 17, 1981

[54] ROLLING MILL SIZING APPARATUS

[75] Inventor: Theodor Zacharias, Meerbusch, Fed. Rep. of Germany

[73] Assignee: Kocks Technik GmbH & Co., Dusseldorf, Fed. Rep. of Germany

[21] Appl. No.: 32,864

[22] Filed: Apr. 24, 1979

[30] Foreign Application Priority Data

May 19, 1978 [DE] Fed. Rep. of Germany ..... 2821888

[51] Int. Cl.[3] ..... B21B 13/10

[52] U.S. Cl. ..... 72/225

[58] Field of Search ..... 72/250, 224, 225, 208, 72/206, 199

[56] References Cited

U.S. PATENT DOCUMENTS

| | | | |
|---|---|---|---|
| 1,890,077 | 12/1932 | Elting | 72/224 X |
| 2,059,124 | 10/1936 | Layton | 72/224 X |
| 2,341,910 | 2/1944 | Diescher | 72/224 |
| 3,229,491 | 1/1966 | Santilli | 72/224 |

*Primary Examiner*—Milton S. Mehr

*Attorney, Agent, or Firm*—Buell, Blenko, Ziesenheim & Beck

[57] ABSTRACT

Apparatus for sizing square metal ingots to be subsequently pierced in a push bench to form pierced blanks for rolling into tubes is provided having freely rotatable sizing rolls to engage the corner edges of the ingot as the ingot is pushed through the support and freely rotatable guiding rollers to engage the side faces of the ingot. The sizing rolls are radially adjustable by means of both a coarse adjustment device and a fine adjustment device while the guiding rollers are only provided with coarse adjustment. The adjustment devices can be computer controlled so that both ends of the ingot are conically tipped and so that the ingot is slightly tapered throughout its length.

10 Claims, 4 Drawing Figures

ROLLING MILL SIZING APPARATUS

This invention relates to rolling mill sizing apparatus and particularly to apparatus for the sizing of metal ingots, e.g. for the sizing of starting material for the production of seamless tubes, in which apparatus adjustable sizing rolls for sizing the ingot are provided in the region of the corner edges of the ingot.

When producing seamless tubes by the so-called push-bench method, square ingots are used since, in contrast to round material, they can be manufactured in a relatively simple and economic manner by rolling or continuous casting. It is common knowledge that the push-bench method commences with the production of a tubular pierced blank of circular cross section which is produced in a piercing press. By way of example, for this purpose a blank of continuously cast material having a square cross section and a predetermined length is used, this starting material being introduced into a cylindrical matrix of the piercing press whose piercing mandrel, when pressed into the matrix, produces the pierced blank provided with a closed bottom at one end.

The quality of this pierced blank, particularly the accurate central position of the pressed-in hole relative to the outer surface, is of great importance for this method of producing tubes. If the piercing mandrel deviates relative to the outer surface during the pressing-in operation, a non-uniform wall thickness is produced and cannot be fully eliminated even during the following processing steps, so that tubes having non-uniform wall thicknesses are ultimately produced.

In addition to the accurate guidance of the piercing mandrel of the piercing press relative to the matrix, the production of a satisfactory pierced blank essentially requires that the ingot should be inserted exactly centrally into the piercing press matrix. Since the ingot has a square cross section, whereas the interior space of the piercing press matrix has a circular cross-sectional configuration, only the corner edges of the ingot abut against the wall of the matrix immediately after the ingot has been inserted. Consequently, the corner edges also determine the position of the ingot in the matrix. In order to obtain a satisfactory pierced blank, and thus tubes having a wall thickness which is as unifrom as possible, it is essential for the corner edges of the ingot to be sized as accurately as possible before insertion into the piercing press matrix, which means that, in particular, the diagonals between the mutually opposite corner edges should be of equal length to ensure that the piercing mandrel is, in fact, applied to the center of the surface area of the ingot and penetrates concentrically of the longitudinal central axis of the ingot.

It now has to be ensured that the interior space of the piercing press matrix is of slightly conical or tapered construction, so that the pierced blank can be readily removed after the pressing operation. The bottom of the matrix remote from the piercing mandrel thereby has a smaller cross-sectional area than the open end portion of the matrix facing the piercing mandrel. Thus, the corner edges of the ingot must slope relative to the longitudinal central axis of the ingot such that they correspond to the conical configuration of the piercing press matrix. This slope of the corner edges of the ingot also has to be produced during the sizing operation.

In a known apparatus for the sizing of metal ingots, as described in German patent specification (Offenlegungsschrift) No. 2424587, the ingot is fixed by a stop in the sizing apparatus, and the sizing rolls are drawn along its corner edges, and, in order to obtain the desired conicity, they are moved transversely away from the longitudinal central axis of the ingot by means of sloping roller tracks in dependence upon the longitudinal travel. Ths slope of the roller tracks, and thus the slope of the corner edges of the ingot, are adjustable. This known apparatus has only two sizing rolls, each of which rolls two corner edges of the ingot. The two roll axes are arranged parallel to one another, so that the adjusting movements of the sizing rolls are not effected radially of the longitudinal central axis of the ingot but are effected in directions at approximately 45° to the radii from the longitudinal axis to the corners of the ingot. In addition to the above-mentioned stop, the ingot is held by elongate guide elements which are intended to ensure that the ingot does not rotate about its longitudinal central axis or does not yield laterally.

This known construction has the disadvantage that sliding friction occurs on the guide elements and necessarily causes corresponding wear on the guide elements, the ingot then being guided inaccurately. Since the corner edges of the ingot extend relatively non-uniformly during production of the ingot, non-uniform forces repeatedly act upon the guide elements during sizing and, in the case of non-accurate guidance, rotate, tilt or displace the ingot, so that accurately sized corner edges of the ingot cannot be obtained. Furthermore, the elongate guide elements can only center the ingot in dependence upon a few bearing points and thus achieve one average position for all the cross-sectional planes of the ingot, so that, in the case of non-linear and/or twisted ingots individual cross-sectional planes are held by the guide elements such that the piercing mandrel does not pierce the center of their surface areas but is offset laterally thereof. Furthermore, in the case of bent or twisted ingots, difficulties arise when introducing the ingots into the known sizing apparatus. The slight clearance of the elongate guide elements is then insufficient, and a larger clearance of play of the guide elements impairs their quality of guidance. A further disadvantage of the known apparatus resides in the fact that the ingot can be conically tipped or tapered across the corner edges only at one end portion. If the ingot is not conically tipped in this manner, the end portions of the pierced blank or the tubular bloom are extruded axially in the vicinity of the corner edges of the ingot to a considerable extent at the end of the pressing operation and particularly at the end of the following pushing operation with the push bench. This results in the blank or bloom having a serrated end so that a relatively long portion has to be cropped and scrapped in an uneconomic manner. This can be largely avoided by conically tipping the ingot across the corner edges before it is inserted into the piercing press, although, with the known construction, this is only possible at one end portion. The ingot is not conically tipped in the region of the bottom of the pierced blank, although it would also be advisable for the blank to be conically tipped in this region for the purpose of avoiding further waste of material.

An object of the invention is to provide ingotsizing apparatus which avoids the disadvantages mentioned above but which renders it possible satisfactorily to size the corner edges of the ingot and which also can be used for a large number of differing ingot cross sections and slopes and configurations of the corner edges of the ingot.

In accordance with the invention, apparatus for sizing polygonal section ingots comprises non-driven sizing rolls for sizing the corner edges of the ingot, a working cylinder for displacing the ingot between the sizing rolls and non-driven guide rollers disposed to engage the ingot in the region of the central circumferential portions of its outer surfaces and thereby guide the ingot between the sizing rolls, the guide rollers being radially adjustable towards and away from the longitudinal central axis of the ingot, and there being provided for each corner edge of the ingot a separate sizing roll which is fixed in the direction of ingot displacement, and which is located in the same cross-sectional plane as the guiding rollers and further comprising for each sizing roll a device for coarse adjustment and a device for fine adjustment, the adjusting movements of which devices are directed radially towards and away from the longitudinal central axis of the ingot.

Thus, in the first instance, substantially only rolling friction takes place between the ingots and the guide elements, and no appreciable wear occurs. Furthermore, by virtue of the fact that the guiding rollers and the sizing rolls are arranged in the same cross-sectional plane, it is ensured that the center of each respective cross sectional area is also guided centrally between the sizing rolls. Furthermore, in the apparatus in accordance with the invention, difficulties with curved and/or twisted ingots do not occur during the sizing operation, since guidance is effected only in the plane of the sizing rolls where, however, it centers the ingot accurately. The guiding rollers and the sizing rolls are fixed in the feed or delivery direction, whilst the ingot is guided through between them in a longitudinal direction by means of the working cylinder. Since a separate sizing roll is provided for each corner edge of the ingot, adjustment is effected in a star-like manner towards the longitudinal central axis of the ingot, that is to say, exactly radially, so that more favorable deformation conditions are created. The sub-division of the adjusting device into a device for coarse adjustment and a second device for fine adjustment of the sizing rolls has the advantage that, on the one hand, greatly differing ingot cross sections can be processed and a correspondingly larger stroke is possible, and, on the other hand, the sizing rolls can be adjusted very accurately, so that it is possible to compensate even for small deviations. It is then possible not only to size the corner edges of the ingots sloping rectilinearly in a longitudinal direction, but also to size them in accordance with a curve of optional configuration. This has the advantage that the corner edges of the ingots then abut only against specific points on the wall of the matrix, thus facilitating the insertion of the ingots into the piercing press matrix. Furthermore, the formation of undulations or indentations on the two end portions can be avoided by means of the apparatus in accordance with the invention, so that less scrap is produced. Namely, by means of the separate coarse adjustment, it is possible, in an advantageous manner, to conically point both end portions of the ingot by moving the sizing rolls away from and towards one another with corresponding rapidity, which, with the fine adjustment, would not be possible in the requisite short period of time. Furthermore, as a result of the large stroke of the coarse adjustment, the apparatus in accordance with the invention can be adjusted to optional dimensions of the ingot without changing the tools.

It is advantageous if the diameters of the sizing rolls are substantially smaller, preferably 30 to 60 percent smaller, than the diameters of the guiding rollers. Small diameters of the sizing rolls have the advantage that smaller rolling forces are produced, thereby the forces acting upon the ingots, and which seek to act against the guiding rollers, are also reduced. Thus, the guide itself is relieved of stress. Furthermore, since the diameter of the guiding rollers is relatively large, these rollers exert correspondingly larger forces and thus effect satisfactory guidance, since a relatively small interference effect is exerted by fluctuations in the forces of the sizing rolls caused by geometrical and material-contingent irregularities of the ingot.

Furthermore, it is advantageous to profile the working surfaces of the sizing rolls in conformity with the desired edge radius. A wide variety of corner edge configurations can be produced in this manner.

In a preferred embodiment of the invention, the sizing rolls and the guiding rollers are commonly mounted in a readily interchangeable housing arranged in or on the support of the apparatus. This renders it possible to change the sizing rolls and/or guiding rollers very rapidly if this should be necessary in the case of damage or natural wear.

A computer can be used to perform the feature, in accordance with the invention, whereby the sizing rolls are adjustable by a large amount radially towards the longitudinal central axis of the ingot for a short period of time during the run-through of the two end portions of the ingot, thus rendering it possible to point or conically taper the two end portions of the ingot across its corner edges. The configuration of the corner edges of the ingot can also be determined in accordance with any optional curve by means of a computer of this type.

The invention is further described, by way of example, with reference to the drawings, in which.

Figure 1:
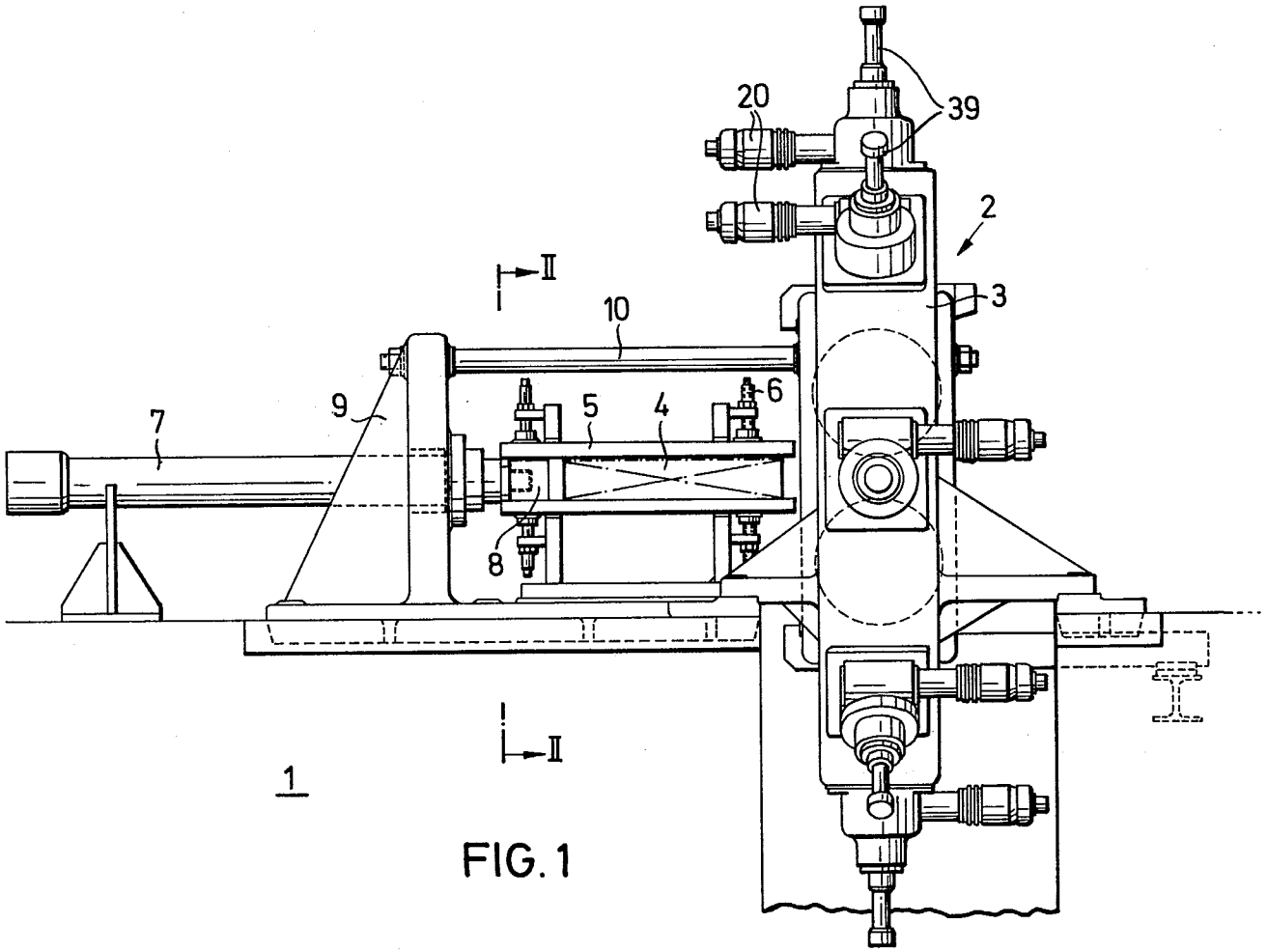
FIG. 1 is a side elevation of one embodiment of ingot sizing apparatus in accordance with the invention.

Referring to FIG. 1, the ingot-sizing apparatus 2 in accordance with the invention rests on a bed 1. The apparatus 2 has a support 3 in or on which are arranged the parts which size the ingot 4 or rather the corner edges thereof and which guide the ingot.

The ingot 4 is carried by a holder 5 which can be adapted to the dimensions of the ingot by means of spindles 6. The holder 5 forms a coarse guide which is adjusted with sufficient play to receive even slightly bent and/or twisted ingots 4. The head 8 of the piston rod of a working cylinder 7, preferably a hydraulic cylinder, acts upon the ingot 4 at that end of the holder 5 which is remote from the apparatus support 3, such that the working cylinder can push the ingot through the apparatus support 3 (to the right as viewed in FIG. 1), the working cylinder 7 being supported on a traverse 9 which is connected to the apparatus support 3 by way of the bed 1 and a tie rod 10.

Figure 2:
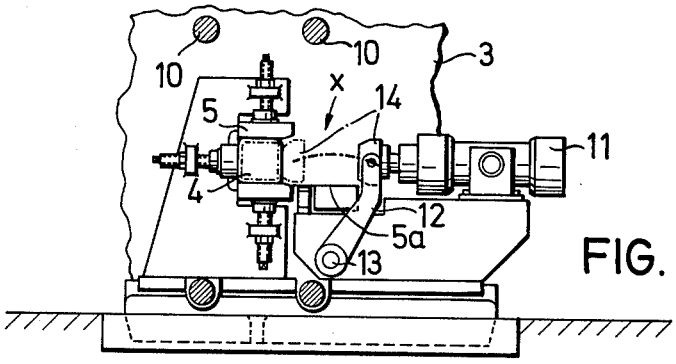
FIG. 2 is a section taken on the line II—II of FIG. 1.

FIG. 2 shows how the ingot 4 is placed onto a support table 5*a* from the direction of the arrow x and is pushed into the holder 5 from the side by means of a further, preferably hydraulic, cylinder 11. For this purpose, a lever 12 is coupled by way of a shaft 13 to a second lever (not visible) of the same type which is located behind the lever 12, the two levers also being interconnected by means of a thrust plate 14 upon which the piston rod of the cylinder 11 acts. When the thrust plate 14, and thus also the ingot 4, have been pushed into the positions shown by dash-dot lines, pressure medium is first admitted to the working cylinder 7, and the ingot 4 is pushed from left to right (as viewed in FIG. 1) through the apparatus support 3 and is thereby sized.

Figure 3:
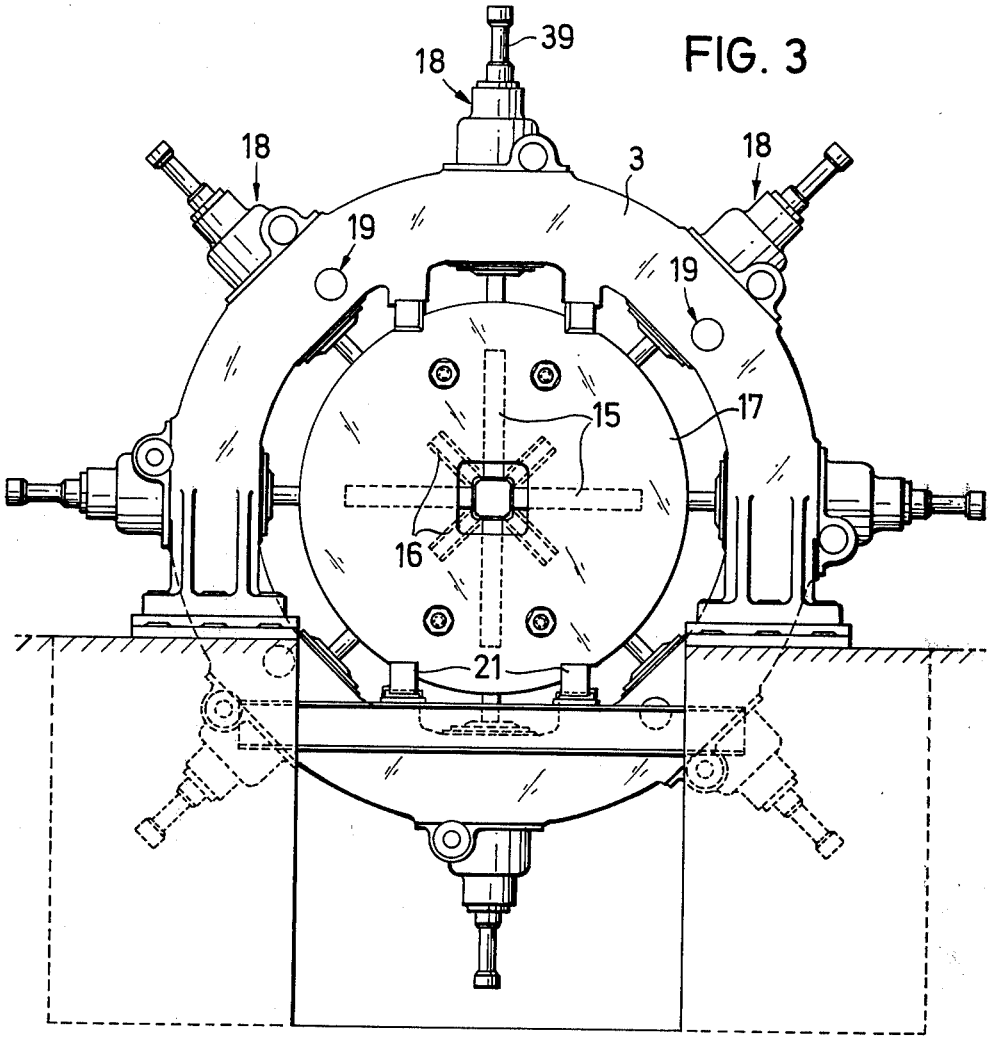
FIG. 3 is an end elevation of the delivery end of the apparatus of FIG. 1.

FIG. 3 shows the arrangement of the guiding rollers designated 15 and the sizing rolls designated 16. The guiding rollers 15 and the sizing rolls 16 are mounted in a readily interchangeable housing 17 which, together with the guiding rollers 15 and the sizing rolls 16 and their bearings, can be rapidly removed from the apparatus support 3. The guiding rollers 15 as well as the sizing rolls 16 are each provided with a coarse adjustment device 18, whereas only the sizing rolls 16 are each additionally provided with a fine adjusting device 19. The coarse adjusting devices 18 are driven by motors 20 which can be seen particularly in FIG. 1. In order to be able to align the longitudinal central axis of the ingot centrally, the interchangeable housing 17 rests on chocks 21 which can be interchanged in conformity with the size of the particular housing 17.

Figure 4:
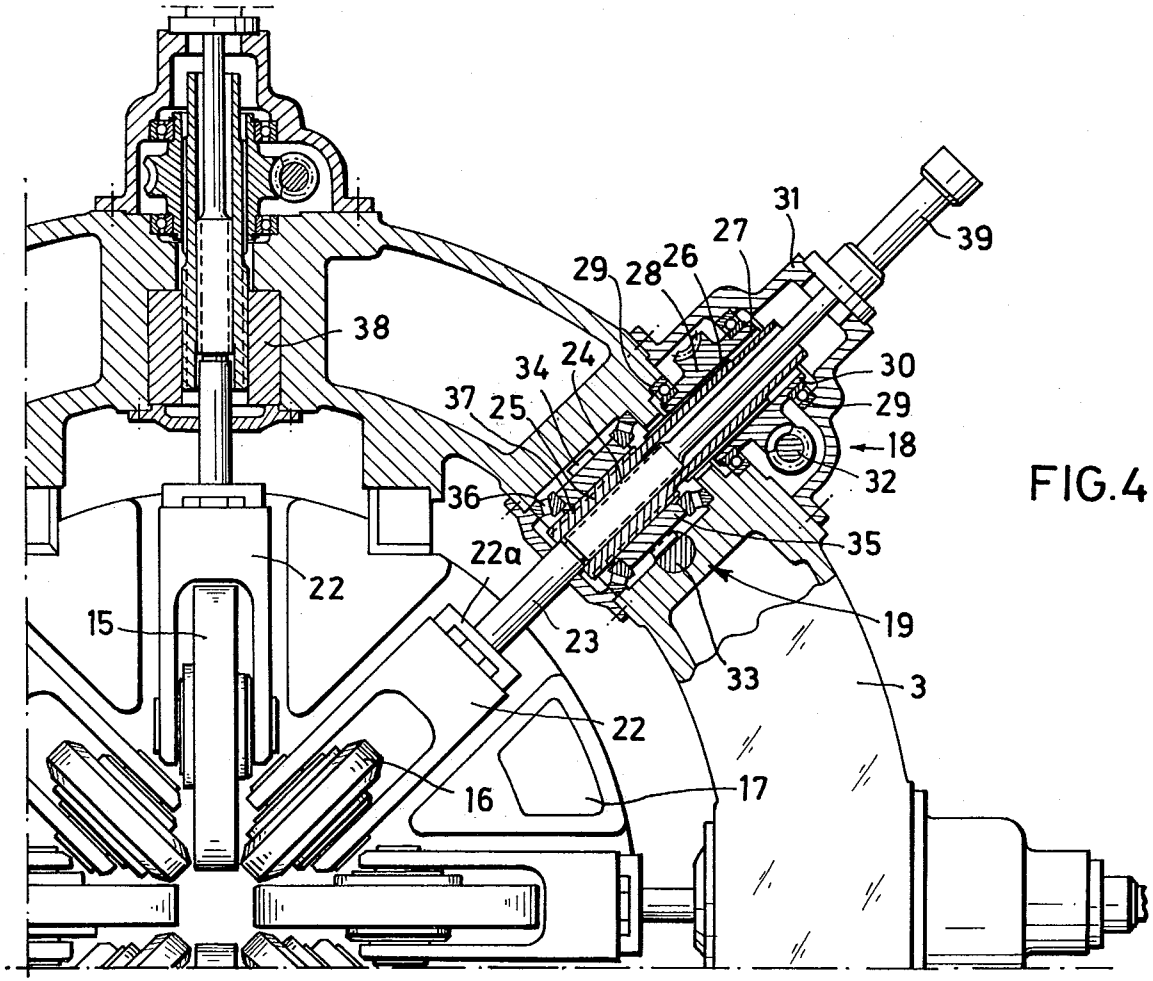
FIG. 4 is a partially sectioned portion of FIG. 3 drawn to large scale.

FIG. 4 shows the construction of the coarse and fine adjusting devices 18 and 19 respectively for the guiding rollers 15 and of the sizing rolls 16, together with their bearings. For reasons of economic manufacture, the adjusting devices 18 for the rollers 15 are made of the same parts as the adjusting devices 18 for the sizing rolls 16, the fine adjusting devices 19 only being omitted in the case of the guiding rollers 15.

The guiding rollers 15 and the sizing rolls 16 are journalled in mountings 22 which are radially displaceably guided in the interchangeable housing 17. The adjusting movement is in each case effected by means of an adjusting spindle 23 which is releasably connected to the associated mounting 22 by means of a coupling **22*a*. This releasable coupling 22*a* is required in the event of the interchangeable housing 17 having to be removed from the apparatus support 3 together with the mountings 22 and the guiding rollers 15 and the sizing rolls 16**.

The couplings **22*a* connect the adjusting spindles 23 to the mountings 22 so as to be non-rotatable relative thereto. The central longitudinal portion of each adjusting spindle has an external thread 24 which engages an internal thread in an adjusting sleeve 25. The outer portion of the adjusting sleeve 25 remote from the mountings 22 is provided with spline-like projections 26 which are axially slidingly but non-rotatably guided in complementary grooves 27 in a worm wheel 28. The worm wheel 28 is axially fixidly but rotatably mounted in the housing attachment of the apparatus support 3 by means of roller bearings 29 and retaining rings 30. The worm wheel 28, driven by a worm shaft 32 which is driven by the respective motor 20 shown in FIG. 1, can rotate and the adjusting sleeve 25 can rotate therewith. The screw thread 24 then axially displaces the adjusting spindle 23 and thus the guiding rollers 15 and the sizing rolls 16. The parts described above form part of the coarse adjusting device 18 and are provided for the guiding rollers 15 and also for the sizing rolls 16** in the same manner.

The fine adjusting device 19 comprises a toothed rack 33 which is axially displaceable by means of a suitable device (not illustrated) and which meshes with teeth 34 on an outer sleeve 35. Displacement of the toothed rack 33 rotates the sleeve 35, which is rotatably, but axially fixedly mounted in the apparatus support 3 by means of roller bearings 36. The sleeve 35 has an internal screw thread whose pitch is opposite to that of the internal screw thread 34 of the adjusting sleeve 25. Consequently, on the one hand, coarse axial adjustment can be effected upon rotating the adjusting sleeve 25 by means of the worm wheel 28 and, on the other hand, when the sleeve 35 is rotated by means of the toothed rack 33, axial movement of the adjusting sleeve 25 and thus of the adjusting spindle 23 can be effected with the worm wheel 28 stationary and thus non-rotation of the adjusting sleeve 25.

Since this fine adjustment is not required in the case of the guiding rollers 15, a nut 38 fixedly inserted in the apparatus support 3 has been used instead of the sleeve 35. Pressure medium is admitted to the clamping cylinders 39, are provided, such that they eliminate the axial play existing in the adjusting devices 18 and 19.

Rapid coarse adjustment of the sizing rolls 16 can be effected by means of the adjusting device 18, radially outwardly as the ingot enters the sizing rolls and radially inwardly as the ingot leaves the sizing rolls. A conical taper or point is thereby provided on each end of the ingot.

The adjusting devices 18 and 19 can be computer controlled not only to provide the conical ends but also to provide a slight taper or draft throughout the length of the ingot.

In the foregoing specification I have set out certain preferred practices and embodiments of my invention; however, it will be understood that this invention may be otherwise embodied within the scope of the following claims.

I claim:

1. Apparatus for sizing metal ingots of polygonal cross section comprising a housing, a plurality of spaced non-driven sizing rolls in said housing, disposed so that one such sizing roll is provided for each corner edge of an ingot to be rolled, fixed in the direction of ingot displacement, a plurality of spaced non-driven guide rolls in said housing disposed to engage the ingot in the region of the central circumferential portions of its outer surfaces and thereby guide the ingot between the sizing rolls, adjustment means for radially adjusting said guide rollers towards and away from the longitudinal axis of said ingot, said sizing rollers and guide rollers being located in substantially the same cross sectional plane of the housing, adjustment means on the housing for coarse radial adjustment of the sizing rollers towards and away from the longitudinal axis of the ingot and positioning means on the housing for fine radial adjustment of the adjustment means on the sizing rollers.

2. Apparatus as claimed in claim 1 in which the diameters of the sizing rolls are substantially smaller than the diameters of the guide rollers.

3. Apparatus as claimed in claim 2 in which the diameters of the sizing rolls are 30% to 60% smaller than the diameter of the guide rollers.

4. Apparatus as claimed in claim 1, 2 or 3 in which the working surfaces of the sizing rolls are profiled in conformity with the desired edge radius.

5. Apparatus as claimed in claim 1, 2 or 3 in which the sizing rolls and the guiding rollers are commonly mounted in a readily interchangeable sub-housing which is removable from the housing.

6. Apparatus as claimed in claim 1, 2 or 3 in which the arrangement is such that the sizing rolls are in each case radially adjustable by a large amount in a short time away from and towards the longitudinal central axis of the ingot during the run-through of the two end portions of the ingot.

7. Apparatus as claimed in claim 1, 2 or 3 in which the guide rollers are provided only with devices for their coarse adjustment towards and away from the ingot axis.

8. Apparatus as claimed in claim 1, 2 or 3 in which the working surfaces of the sizing rolls are profiled in conformity with the desired edge radius and the sizing rolls and guiding rollers are commonly mounted in an interchangeable housing removably fitting on a base member.

9. Apparatus as claimed in claim 1, 2 or 3 in which the working surfaces of the sizing rolls are profiled in conformity with the desired edge radius of the ingot and are radially adjustable by a large amount in a short time period toward and away from the longitudinal central axis of the ingot during the run through of the two end portions of the ingot.

10. Apparatus as claimed in claim 5 wherein said adjustment means for the guide rollers and sizing rollers is carried in the housing and are connected to the guide rolls and sizing rolls in said sub-housing by connecting spindles.

* * * * *